United States Patent [19]

Hillenbrand

[11] Patent Number: 4,876,172

[45] Date of Patent: Oct. 24, 1989

[54] IMAGING METHOD EMPLOYING PHOTOADHESIVE MICROPARTICLES

[75] Inventor: Gary F. Hillenbrand, Springboro, Ohio

[73] Assignee: The Mead Corporation, Dayton, Ohio

[21] Appl. No.: 52,520

[22] Filed: May 20, 1987

[51] Int. Cl.[4] ..... G03C 1/46; G03C 1/72; G03C 5/40

[52] U.S. Cl. ..... 430/253; 430/106; 430/106.6; 430/138; 430/394; 430/502

[58] Field of Search ..... 430/138, 394, 502, 106, 430/106.6, 253

[56] References Cited

U.S. PATENT DOCUMENTS

| | | | |
|---|---|---|---|
| 3,080,251 | 3/1963 | Claus | 117/17.5 |
| 3,915,704 | 10/1975 | Limburg et al. | 96/27 |
| 3,984,253 | 10/1976 | Nelson | 96/35.1 |
| 4,013,572 | 3/1977 | Marsh et al. | 252/62.1 |
| 4,108,839 | 8/1978 | Chambers et al. | 528/270 |
| 4,254,201 | 3/1981 | Sawai et al. | 430/138 |
| 4,456,669 | 6/1986 | Yubakami et al. | 430/35 |
| 4,536,462 | 8/1985 | Mehl | 430/138 |
| 4,536,463 | 8/1985 | Sanders | 430/138 |
| 4,551,407 | 11/1985 | Sanders et al. | 430/138 |
| 4,576,891 | 3/1986 | Adair et al. | 430/512 |
| 4,587,194 | 5/1986 | Adair et al. | 430/138 |
| 4,601,967 | 7/1986 | Suzuki et al. | 430/138 |
| 4,622,282 | 11/1986 | Head et al. | 430/138 |
| 4,675,269 | 6/1987 | Saccocio et al. | 430/138 |
| 4,701,397 | 10/1987 | Rourke et al. | 430/138 |

FOREIGN PATENT DOCUMENTS

| | | |
|---|---|---|
| 9519 | 3/1978 | Japan . |
| 9520 | 11/1978 | Japan . |

*Primary Examiner*—Mukund J. Shah

*Attorney, Agent, or Firm*—Smith & Schnacke

[57] ABSTRACT

A process for forming images which comprises forming a continuous layer of photosensitive microparticles, said microparticles being formed from a material which becomes tacky upon exposure to actinic radiation, image-wise exposing said layer to actinic radiation such that said particles become tacky in the exposed areas, assembling said layer with a receive sheet, and transferring said microparticles to said receiver sheet in the exposed areas.

12 Claims, 2 Drawing Sheets

P
30

66
44
40
42
46
48
50
52
54
55
56
58
60
62
68

70
20
14

72
20
14

IMAGING METHOD EMPLOYING PHOTOADHESIVE MICROPARTICLES

BACKGROUND OF THE INVENTION

The present invention relates to an image-forming process employing photoadhesive microparticles and, more particularly, to a method wherein a layer of photoadhesive microparticles containing an image-forming agent is image-wise exposed and the microparticles are differentially transferred to an image-receiving substrate to provide an image.

Imaging methods employing microparticles are known in the art. Many of these methods rely upon xerographic methods to form the image. For example, U.S. Pat. No. 3,080,251 to Claus describes a xerographic method in which a toner comprising a color-forming composition encapsulated in a shell having triboelectric properties suitable for electrostatic deposition is image-wise electrostatically deposited on a developer sheet where the capsule is ruptured to provide an image; and U.S. Pat. No. 4,013,572 to Marsh describes a photo-fixable toner prepared from a photodegradable polymer.

U.S. Pat. No. 4,456,669 to Yubakami et al. discloses a method in which conductive particles containing a sublimable color former are electrostatically deposited on a support member according to an image signal. The color former is transferred to the paper by a heat-transfer process in which the color former is vaporized. The image is developed by reaction of the color former with a developer composition. The patent also discloses a method for forming full color images wherein the particles are coated with colored solutions to give them a color separation function. The particles are deposited on a uniformly charged photoconductive support which is exposed to light through the particle layer. Exposure selectively releases the particles from the support resulting in a particle image. This image is heated to transfer the color former and developed as discussed above.

Japanese patents 9519 and 9520 to Ricoh describe image-forming methods in which microcapsules containing a photographic color coupler are said to be photoadhesively transferred to an image-receiving sheet where the coupler is reacted with a developer to produce an image. According to the disclosure, the microcapsules are prepared by dispersing a composition containing a monomer and a color coupler in polyvinyl alcohol containing a photoinitiator. It is not clear from the disclosure that this preparation actually yields a microcapsule or how the composition exhibits photoadhesive characteristics. According to the disclosure, microcapsules in the exposed areas cure and thereby become more strongly adhered to the support upon which they are carried such that upon assembling the material with a transfer sheet and applying pressure or heat, the unexposed capsules selectively adhere to the transfer sheet.

Commonly assigned U.S. applications Ser. No. 770,538 filed Aug. 28, 1985 and Ser. No. 800,018 filed Nov. 20, 1985 also disclose image-forming methods employing microparticles. The former application discloses a process for forming images on plain paper wherein free-flowing microcapsules containing a photohardenable composition and a color precursor are deposited on a support, image-wise exposed to radiation and ruptured in contact with an image-receiving sheet to which they release the color precursor. In one embodiment, the microcapsules are designed with triboelectric properties such that they can be electrostatically maintained on the support during exposure of the microcapsules and during transfer of the color precursor.

In the latter application, a layer of microparticles formed from a photodegradable polymer containing a color precursor is image-wise exposed to actinic radiation and assembled with a developer sheet to which they release the color precursor to provide the image. This imaging system does not rely upon photoadhesion to transfer the microparticles to the image-receiving sheet.

SUMMARY OF THE INVENTION

The present invention is directed to an image-forming method which comprises the steps of:

(a) forming a two layer of photoadhesive microparticles, said microparticles being formed from a material which becomes tacky upon exposure to actinic radiation, and containing an image-forming agent.

(b) image-wise exposing said layer to actinic radiation such that said microparticles become tacky in the exposed areas, (c) assembling said layer with a receiver sheet, and (d) transferring said particles to said receiver sheet in the exposed areas.

The photosensitive microparticles are designed with photoadhesive characteristics such that particles exposed to radiation become tacky and are transferred, upon contact and application of pressure, to an image-receiving sheet (e.g., paper), while particles in the unexposed areas remain non-tacky and are not transferred. In this manner, an image is formed by the transferred particles on the image-receiving sheet or by the untransferred particles which remain on the donor sheet.

In some cases, the microparticles used in the present invention are coated pigments. Colored pigments can be coated with a phototackifiable composition in accordance with the present invention, distributed in a layer on a support, exposed to radiation, and transferred to a receiver sheet where they form an image. In other cases, the microparticles are simply a mixture of an image-forming agent and a phototackifiable composition.

In accordance with one embodiment of the invention, full color images are formed by using cyan, magenta and yellow colored microparticles.

Figure 6:
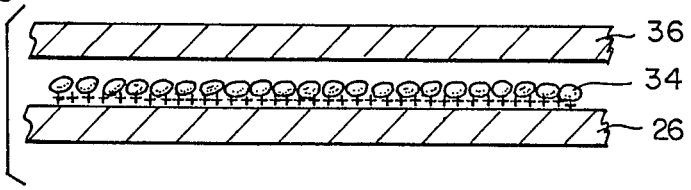

5 and assembled with a receiver sheet as shown in FIG. 6.

Figures 7, 8, 9, 10:
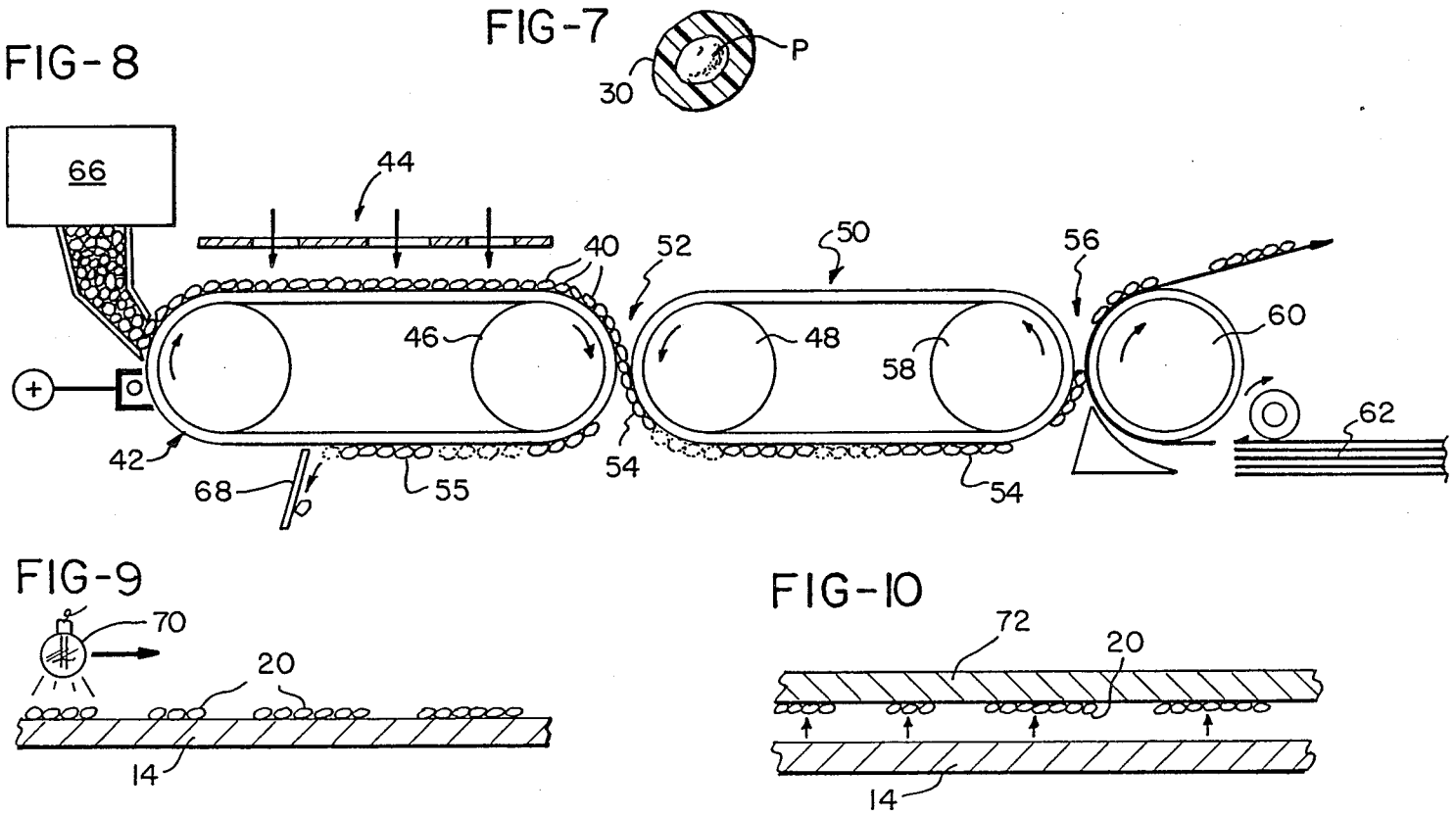

FIG. 7 is one example of a microparticle useful herein.

FIG. 8 is a schematic view of an apparatus useful in forming images using microparticles in accordance with the present invention. FIGS. 9 and 10 illustrate a reversal process.

DETAILED DESCRIPTION OF THE INVENTION

The image-forming process of the present invention is described in more detail below by reference to the figures.

Figure 1:
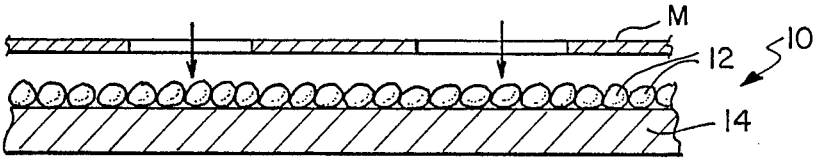
FIG. 1 is a cross-sectional illustration of exposure of a layer of microparticles in accordance with the present invention.
Figure 2:
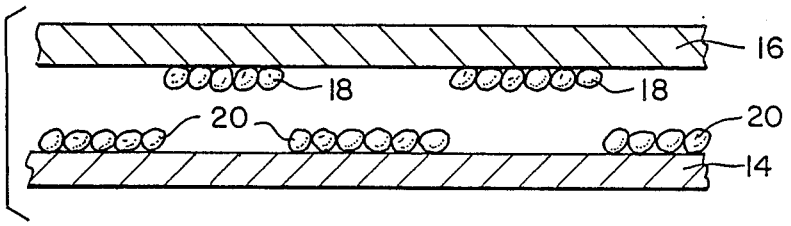
FIG. 2 is a cross-sectional illustration of the process whereby microparticles are transferred to a receiver sheet after exposure.

FIG. 1 illustrates one embodiment in accordance with the present invention in which a layer 10 of microparticles 12 is distributed on a support member 14. The microparticles are held in position simply by gravity or by a weak adhesive in this embodiment. The layer of microcapsules is exposed to actinic radiation, as designated by the arrows, through a mask M. As shown in FIG. 2, the exposed layer of microparticles 10 is contacted with an image receiving sheet 16. This can be a sheet of plain paper or a sheet which has been designed by coating or preparation to accept or adhere the microparticles. By the application of pressure, the exposed microparticles 18 in the exposed areas selectively adhere to the receiver sheet. Application of pressure may also cause the microparticles to coalesce at least partially but does not necessarily. On the other hand, the microparticles 20 in the unexposed areas remain on the support 14 when the receiver sheet 16 is removed.

Very often, image-wise exposure tackifies only the surface of the particles adjacent the light source. While this is adequate to effect differential transfer of the microparticles, it may be desirable to perform additional treatment to fix the microparticles to the receiver sheet. For example, after transfer of the microparticles, the sheet 16 may be heated and/or uniformly exposed to cause or enhance coalescence of the microparticles and provide a less grainy image or to enhance their adhesion to the receiver sheet.

The microparticles 12 are formed from a phototackifiable composition. Representative examples of these compositions are described in more detail below. The microparticle may be formed by compounding the phototackifiable composition with an image-forming agent in which case the particle may simply be a composite, solid solution or mixture of the two materials. In accordance with another embodiment of the invention, however, as shown in FIG. 7, the microparticle is formed by coating a pigment P with a layer 30 of phototackifiable composition. The pigment P may be any of a variety of materials as discussed below.

Figure 3:
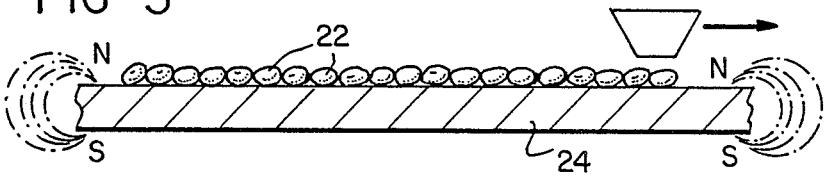
FIG. 3 illustrates one embodiment in accordance with the present invention wherein the microparticles contain a magnetically attractable material and are maintained in position on a magnetized support or image-receiving sheet.

FIG. 3 illustrates another embodiment of the invention in which the microparticles include a magnetically attractable material such as an iron filing or an iron oxide. The purpose of incorporating the magnetically attractable material into the particle is to maintain the microparticles on the surface of the support while the layer of microparticles is exposed and developed as shown in FIGS. 1 and 2 above. In this embodiment, the magnetically attractable material may also function as the pigment. Alternatively, a separate pigment or dye may be added as an image-forming agent. In accordance with the embodiment shown in FIG. 3, particles 22 containing the magnetically attractable material are distributed upon a magnetized support 24 from a gravity fed hopper or other dispenser 25. Magnetization of the support is indicated by field lines. Support 24 can be a material such as paper to which a magnetic field is applied using a magnet or electromagnet placed beneath the paper; or it can be formed of a material having magnetic or electromagnetic properties.

Figure 4:
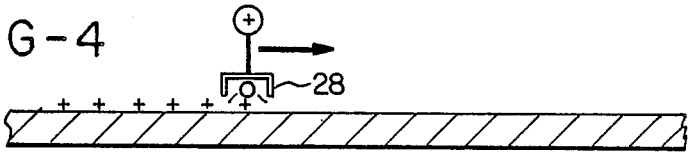
FIGS. 4–6 illustrate another embodiment in accordance with the present invention in which a photoconductor is uniformly charged as shown in FIG. 4, microparticles having triboelectric properties are electrostatically held on the photoconductor as shown in FIG.
Figure 5:
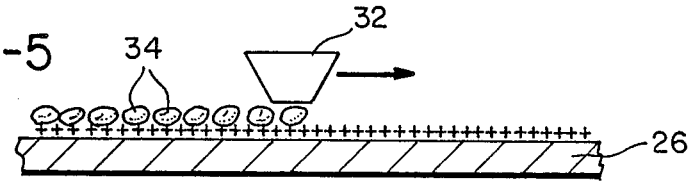

In accordance with the embodiment shown in FIGS. 4, 5 and 6, the microparticles are distributed using electrostatic properties. In accordance with this embodiment, a support member 26 is electrostatically charged by electrode member 28 which sweeps the plate from right to left in FIG. 4. Microparticles having triboelectric properties are deposited on the support from hopper or dispensing means 32 to form the layer 34. After deposition of the microparticles, in accordance with this process, layer 34 is image-wise exposed as shown in FIG. 1. The exposed layer is assembled with a receiver sheet 36 as shown in FIG. 6. The receiver sheet is pressed against the layer 34 such that the microparticles become adhered to the receiver sheet in the exposed areas. Before removing the receiver sheet, the member 26 may be discharged thereby freeing the microparticles from the surface. Upon removing the receiver sheet, the microparticles are adhered to the receiver sheet in the expose areas and remain on the support in the unexposed areas in a manner analogous to FIG. 2.

FIG. 8 schematically illustrates an apparatus design which may be useful in practicing the present invention. In FIG. 8, microparticles 40 are carried on a first belt 42 which may be magnetic or electrostatically charged. On belt 42, the microparticles 40 are conducted through an exposure station 44 where they are image-wise exposed to actinic radiation (as indicated by the mask M and the arrows). Following exposure, the microparticles 40 are transported between pressure rollers 46 and 48 where they are contacted with a receiver means 50. As the microparticles pass through the nip 52 between rolls 46 and 48, they are image-wise, differentially transferred to the receiver means 50.

In one embodiment, the receiver means 50 is the sheet (e.g. paper) upon which the image is to be formed. In the embodiment shown in FIG. 8, however, receiver means 50 is an intermediate transfer belt which transports the transferred particles 54 to a second pressure nip 56 formed between rollers 58 and 60. Nip 56 is supplied with image-receiving sheets such as plain paper or transparency 62 to which the microparticles 54 are transferred as shown at 64. As belt 50 leaves the nip 56, it is cleaned of the microparticles 54 and is ready to receive the microparticles for forming the next image.

As a further aspect of such an apparatus, the microparticles 40 are resupplied to belt 42 from dispenser 66. As belt 42 leaves nip 52 it may carry the unexposed microparticles 55. If the particles are held on the belt by gravity or another force which is discharged, unexposed particles may simply fall from or be cleaned from the belt after the nip 52. The microparticles 55 may be cleaned from the belt by means 68 (e.g., felt) such that upon passing dispenser 66 a uniform layer of microparticles may be provided easily.

It will also be noted that the process of the present invention may be used to form positive as well as negative images. The processes illustrated in FIGS. 1–6 are negative-working. Following transfer, however, the microparticles remaining on the original support, i.e., the untransferred particles, can be used to form a positive image. The untransferred microparticles can be uniformly exposed to actinic radiation to make them adhesive and subsequently transferred. This is illustrated in FIG. 9 where the support member 14 carrying untransferred capsules 20 corresponding to FIG. 2 is uniformly exposed by radiation source 70 which travels across its surface. When the uniformly exposed sheet is contacted with a second image-receiving sheet 72, the microcapsules 20 are transferred as shown in FIG. 10.

The process of FIGS. 9 and 10 can be implemented using a modification of the apparatus of FIG. 8. In this modification, which is not illustrated, belt 50 is used simply to remove microparticles from belt 42. After leaving the nip 52, the microparticles remaining on belt 42 can be uniformly exposed to light to effect transfer to a receiver sheet which is mated with the belt 42 downstream of nip 52.

The photosensitive compositions used in forming the microparticles of the present invention must exhibit the property of being capable of being formed into discrete particles or being coated upon discrete particles such as pigment and the property of becoming selectively tacky upon exposure to actinic radiation. Compositions having these properties are known in the art particularly in the area of peeling development systems.

Representative examples of phototackifiable compositions useful in the present invention are described in U.S. Pat. Nos. 4,108,839; 3,984,253; and 3,915,704. These compositions contain polyaldehydes, but other depolymerizable materials such as compositions containing polycarbonates as disclosed by Cruello, "Application of Photoinitiated Cationic Polymerization to the Development of New Photoresists", *Polymers in Electronics,* ACS 242, p3, and Frechet et al., *J. Imaging Science,* 30 (2), p. 59 (1986); compositions containing polyethers as disclosed by Goethals, E. J., "The Formation of Cyclic Oligomers in the Cationic Polymerization of Heterocycles", *Adv. Poly. Sci.,* Vol. 23, p. 103; compositions containing poly(olefin sulfones) as disclosed by Hiraoka, H. "Deep U.V. Photolithography with Composite Photoresists made of Poly(olefin sulfones)", *Polymers in Electronics,* ACS 242, p. 55; Bowden, M. J., et al. ibid, pp. 135 and 153; and U.S. Pat. No. 3,935,331 to Poliniak et al.; and compositions containing poly(3-oximino-2-butanone methacrylate) or poly(4'-alkyl acylophenones), which undergo main chain scission upon exposure, (see Reichmanis, E., *Am. Chem. Soc. Div. Org. Coat. Plast. Chem. Prepr.,* 1980, 43, 243–251 and Lukac, I., Chmela, S., *Int. Conf. on Modif. Polym. 5th Bratislave, Czech.,* July 3–6, 1979, I.U.P.A.C. Oxford, England, 1979, 1, 176–182, may also be useful. Polysulfones of the type used in thermal transfer systems are potentially useful.

The polyaldehydes which are useful in the present invention include poly(aromatic 1,2-dialdehydes), poly(aliphatic monoaldehydes), and copolymers thereof. These polymers undergo cationic depolymerization.

Polyaldehydes may be end-capped with a group which stabilizes the polymer to depolymerization in a known manner. The end-capping group may be one which is photolabile and which separates from the polymer directly upon exposure to radiation, or be one which is acid cleavable, such as an ester or an ether group, and which separates from the polymer in the presence of a photogenerated acid. Alternatively, the polymer maybe sufficiently stable to be processable into the microparticle without end-capping. Each of these polymer systems has a basis in the prior art.

Other potentially useful depolymerizable systems are the metal-crosslinked polymer gels described in U.S. Pat. No. 3,097,097 to Oster et al., the compositions containing bichromated gelatin described in U.S. Pat. Nos. 2,484,451 and 2,500,028 to Griggs; the photodegradable polyolefin compositions described in U.S. Pat. No. 3,968,095 to Freedman et al.; compositions containing polymers having acid cleavable C—O—C groups as disclosed in U.S. Pat. No. 4,421,844 to Buhr et al. such as polyalkylaryl ethers disclosed in U.S. Pat. No. 4,435,496 to Walls et al.; compositions containing polyketones as described in U.S. Pat. Nos. 3,923,514 to Marsh; 4,419,506 to Nate et al. and 4,297,433 to Tsuda et al.; compositions containing polymethacrylates such as those described in U.S. Pat. Nos. 4,125,672 to Kakuchi and 3,779,806 to Gipstein et al., and photo-plasticized binder/acetal compositions as described in U.S Pat. No. 4,356,252 to Lee.

Of the aforementioned depolymerizable systems, those which hold the most potential are those which combine an initiator which generates an acid upon exposure and an acid degradable polymer. For example, compositions employing initiators such as onium salts which undergo photolysis to produce strong acids which catalyze main chain scission of a polymer may be used. These systems are preferred to the others because a single photochemical event generates the acid which produces a number of bond transformations leading to complete or nearly complete reversion to the monomer. Included within this class of photodepolymerizable systems are compositions of acid degradable polyaldehydes, polycarbonates and polyethers.

Another useful polymer is one which is crosslinked by an acid cleavable linking group. Exposure generates an acid as above which depolymerizes the linking group. Still another class of useful polymers are copolymers having acid degradable units or blocks in the polymer backbone.

Each microparticle includes an initiator which generates an acid, a cation, or a free radical which initiates depolymerization upon exposure. The initiator may be incorporated into the polymer chain, appended to the polymer chain, or simply mixed with the polymer. Useful initiators for polyaldehydes include photogenerated acid precursors such as (i) triarylsulphonium hexafluorophosphates, triarylsulphonium arsenates and triarylsulphonium antimonates, (ii) diaryliodonium hexafluorophosphates, diaryliodonium arsenates and diaryliodonium antimonates, (iii) dialkylphenacylsulfonium tetrafluoroborates and dialkylphenacylsulfonium hexafluorophosphates, (iv) dialkyl-4-hydroxyphenylsulfonium tetrafluoroborates and dialkyl-4-hydroxyphenylsulfonium hexafluorophosphates. Other useful initiators include halogen-containing compounds such as carbon tetrabromide, hexachloroethane, tribromoacetophenone, etc. and diazo compounds such as diazonium salts and o-quinonediazides, etc.

The foregoing compounds may be used alone or in combination with a sensitizer. Useful sensitizers for diaryliodonium compounds include Acridine Orange, Acridine Yellow, Phosphine R, Benzoflavin and Setoflavin T. Anthracene, perylene, phenothiazine, 1,2-benzanthracene, coronene, pyrene, and tetracene are useful sensitizers for triarylsuphonium arsenates, diaryliodonium arsenates and dialkylphenacyl sulphonium compounds. Ketocoumarins are also useful sensitizers. These sensitizers are used in conventional amounts.

Potentially promising initiators are the onium-dye complexes described in commonly assigned U.S. application 944,305 filed Dec. 18, 1986.

The microparticles of the present invention can be used to control the release of various image-forming agents.

In accordance with the preferred embodiment of the present invention, the microparticles are formed from an image-forming pigment. Various pigments can be used in accordance with the present invention and, as indicated above, in one embodiment these pigments may be magnetically attractable to assist in forming the microparticle layer.

In accordance with one embodiment of the present invention, the microparticles are designed with triboelectric properties which permit their electrostatic deposition to form a microparticle layer or array. Microparticles having triboelectric properties are described in U.S. Pat. No. 4,013,572, which is incorporated herein by reference.

Representative examples of pigments useful in the present invention include simple colored solids as well as particles formed from polymer or wax compositions containing a dye or pigment. Solid pigments are coated with the photodegradable composition or admixed with the photodegradable composition and formed into a particle. Polymeric or wax pigment compositions can be formed into particles and coated with the photodegradable compositions.

Examples of useful pigments are C.I. Pigment Yellow (C.I. 21096), C.I. Pigment Red (C.I. 15850), C.I. Pigment Blue (C.I. 74160). A magnetically attractable pigment is C.I. Pigment Black (C.I. 77499). Also useful in the present invention are heat-fusible pigmented polymers. For example wax particles containing cyan, magenta and yellow dyes, xerographic toners both colored and black, and polymer dye solutions are useful. Potentially useful fusible binders include polystyrene, polyvinyl acetate, methacrylate, vinyl chloride, phenolic rosin, etc. Further examples are provided in *Electrophotography,* Schaffert, R. M., Focal/Hastings House, 1975, ISBN-0-8038-1941-2, Table 5, p. 73. Examples of useful dyes are C.I. basic yellow (C.I. 41000), C.I. Basic Violet (C.I. 45170) and C.I. Basic Blue (C.I. 42595).

Heat-fusible pigments are desirable for use in those embodiments enhanced fixation of the microparticles to the receiver sheet is desired. After transfer, the microparticles are heated. Heat fusible systems are also useful when the image-former is a dye precursor or color former. Heating releases the color former from the transferred microparticle for reaction with a developer.

In one embodiment of the present invention, the microparticles can contain a benign visible dye and images are formed by contacting the exposed microparticle layer under pressure with a plain paper or a paper treated to enhance its affinity for the particles. A benign dye is a colored dye which does not interfere with the imaging photochemistry, (e.g., by unacceptably relaxing the excited state of the initiator or detrimentally absorbing or attenuating the exposure radiation). The image is formed by the colored particles transferred on the paper. Examples of cyan, magenta and yellow image-forming dyes are disclosed in U.S. Pat. No. 4,500,624.

Images can also be formed through the reaction of a pair of chromogenic materials such as a color former and a color developer. In this case, the microparticles act as a carrier for the color former. The developer may be present on the receiver sheet or it may be applied from solution or the like after transfer of the microparticles. In general, color formers include colorless electron donating compounds having in their partial skeleton a lactone, a lactam, a sultone, a spiropyran, an ester or an amido structure such as triarylmethane compounds, bisphenylmethane compounds, xanthane compounds, fluorans, thiazine compounds, spiropyran compounds and the like. These materials are conventionally used in carbonless paper. Crystal Violet Lactone, 2,6-diphenyl-4-(4'-dimethylaminophenyl)-pyridine, and Copikem X, IV, and XI are a few examples.

The foregoing compounds are acid developable and therefore inherently basic. As such, they may compete with certain acid degradable polymers for the photogenerated acid in certain embodiments.

Another type of chromogenic material which may be preferred for use in the present invention is a base-developable chromogenic material. These materials include the phenolphthaleins such as sulfobromophthalein sodium tetrahydrate, phenolphthalein, bromophenol blue, bromocresol green, bromocresol purple, and bromothymol blue.

In addition to carbonless paper-type color precursors, color photographic dye couplers can also be used as image-forming agents in accordance with the present invention. These materials may be developed using conventional phenolic or anilino photographic developers.

Illustrative examples of the developer materials conventionally employed in carbonless paper technology which are also useful electron donating color precursors in the present invention are clay minerals such as acid clay, active clay, attapulgite, etc.; organic acids such as tannic acid, gallic acid, propyl gallate, etc.; acid polymers such as phenol-formaldehyde resins, phenol acetylene condensation resins, condensates between an organic carboxylic acid having at least one hydroxy group and formaldehyde, etc.; metal salts or aromatic carboxylic acids such as zinc salicylate, tin salicylate, zinc 2-hydroxy naphthoate, zinc 3,5 di-tert butyl salicylate, zinc 3,5-di($\beta$-methylbenzyl) salicylate, oil-soluble metal salts or phenol-formaldehyde novolak resins (e.g., see U.S. Pat. Nos. 3,672,935; 3,732,120; and 3,737,410) such as zinc-modified oil-soluble phenol-formaldehyde resin as disclosed in U.S. Pat. No. 3,732,120, zinc carbonate, etc., and mixtures thereof.

To develop the base-developable chromogenic materials, weak bases such as sodium carboxylate or basic resins may be used.

Various methods can be used to form the microparticles of the present invention. A solution of the photo-tackifiable polymer and other additives (e.g., the initiator, sensitizer, and image-forming agent) in a water-miscible or a water immisiible solvent can be added to an aqueous solution of a stabilizing agent (e.g., an anionic, amphoteric or ionic surfactant such as sodium lauryl sulfate; pectin; or polyvinyl alcohol) under high sheer mixing and the dispersion or suspension, coated on a support and the water removed through drying. Where the solvent used is immiscible in water, it is preferably removed prior to coating.

Alternatively, a polymer melt containing the other additives can be dispensed into an aqueous solution of an appropriate surfactant without a solvent and the dispersion coated on an appropriate support. Another method which can be used to form the microparticles is spray drying wherein a solution of the polymer and additives is aspirated into a heated air space.

The composition of the microparticles used in the present invention will vary depending upon the nature of the photosensitive composition and the image-forming agent. In particular, in forming full color images, the composition of the mixtures of microparticles will be adjusted to provide the appropriate color balance. Generally, microparticles in accordance with the present invention contain approximately 0.1 to 25 parts by weight of the image-forming agent per 100 parts by weight of the photodegradable composition and preferably 0.1 to 10 parts by weight.

A microparticle size should be selected which minimizes light attenuation. The mean diameter of the microparticles used in this invention typically ranges from approximately 1 to 25 microns. As a general rule, image resolution improves as the size decreases. If the microparticles become too small, they may disappear in the pores of the fiber of the substrate. These very small microparticles may therefore be screened from exposure by the substrate. It has been determined that a preferred mean microparticle diameter range is from approximately 3 to 15 microns, and particularly, 3 to 10 microns.

The most common receiver sheet for use in this invention is paper. The paper may be a commercial impact raw stock, or special grade paper. Alternatively, transparent substrates such as poly(ethylene terephthabte) can be used to form a transparency.

The imaging materials of the present invention can be designed to provide monochromatic or full color images. Image processing techniques are desirably used to form full color images.

Processes in accordance with the present invention for forming full color images are now described. In one process three or four sets of microparticles containing cyan, magenta, and yellow and optionally black image-forming agents are used. Since the microparticles are negative working, the process involves an electronic or mechanical inversion of the subject image to produce the reciprocal image. Thus, in areas corresponding to the red image, the magenta and yellow microparticles must be transferred to form a red image. In areas corresponding to the green image, yellow and cyan agents must be transferred, and in areas corresponding to the blue image, cyan and magenta agents must be transferred.

Two formats are proposed. In one, separate layers of cyan, magenta, yellow and optionally black microparticles are formed and exposed through a negative color separation. Each of the exposed layers of microparticles is contacted in face-to-face registration with an image-receiving sheet where the full color positive image is composed.

The more preferred method for forming full color images utilizes a layer of an admixture of three or four sets of microparticles respectively containing cyan, magenta, yellow, and optionally, black image-forming agents. In accordance with this embodiment of the invention, the photosensitive compositions from which the microparticles are formed have distinctly different sensitivities to actinic radiation such that each set of microparticles can be exposed without exposing the other sets of microparticles. In accordance with this embodiment of the invention, the microparticles may be formed from different photosensitive compositions containing different initiator systems.

To form full color images using electronic inversion, an original may be viewed with a Dunn or matrix camera and the red, green and blue channel outputs electronically inverted to provide reciprocal red (-red), reciprocal green (-green), and reciprocal blue (-blue) image information. This information is then used to drive the radiation source. Three exposures at three wavelengths which are respectively indicated as λ-1, λ-2, and λ-3 are made. In areas exposed to λ-1, the microparticles sensitive to λ-1 radiation carrying the cyan image former or pigment are transferred. The microparticles sensitive to λ-2 and λ-3 radiations, however, are not transferred. In a parallel fashion, in areas exposed to λ-2, the microparticles sensitive to λ-2 carrying the magenta image former are transferred whereas the microparticles sensitive to λ-1 and λ-3 are not. In areas exposed to λ-3 radiation, the microparticles sensitive to λ-3 radiation carry the yellow image-former and transfer whereas the microparticles sensitive to λ-1 and λ-2 radiation do not. In this manner, the microparticles image-wise carry the image-formers to the receiver sheet where a full color positive image is formed.

Color images can also be formed in accordance with the present invention using negative color seps or separations. Each color sep is mounted over the layer of microparticles and an exposure is made at one of the wavelengths to which the microparticles are sensitive.

In another embodiment, a mechanical inversion as illustrated in FIGS. 9 and 10 is used in producing the image rather than an electronic inversion as described above. In this case, the microparticles can be sensitive, respectively, to red, green and blue light. A layer of the particles can be exposed by direct transmission or reflection imaging. An initial transfer is made of the exposed particles. This produces a transfer image which is a color negative. The particles remaining on the support after transfer of the exposed particles constitute a color positive image. These particles can be uniformly exposed to white light such that they are uniformly tackified and transferred to a receiver sheet to produce a color positive image.

The present invention will be illustrated in more detail by the following non-limiting Example.

EXAMPLE

A solution of 4.0 g poly(phthaldehyde)-pyridine end capped, 0.4 grams of diphenyliodonium hexafluorophosphate, and 0.04 g of isopropylthioxanthone in a 100 ml of dichloroethylene was placed in a round bottom flask with 90 grams of iron particles at (about 100 microns). The dichloroethane was slowly evaporated. This yielded iron particles coated with a film consisting of poly(phthaldehyde), diphenyliodonium hexaflurophosphate and isopropylthioxanthone. The particles were cemented together in hard lumps and required grinding in a mortar with pistle before they could be used. Handling and Exposure: a magnet array (made from strip magnet) was affixed to the counter top. A sheet of xerographic bond paper was taped over the magnet array, and the coated iron particles were sprinkled onto the cover sheet. Topping and brushing were used to generate an even distribution of iron particles on the sheets arranged along the magnet force lines. The distribution of imaging particles was exposed through a transparency to light from a long wave UV mineral light for 360 seconds. Following this, the transparency was removed carefully, another sheet of paper was taped over the exposed sheets and pressure was applied by gently but firmly, rolling a rubber-covered roller over the entire surface. Separation of the sheets afforded a negative image. This exposure was repeated similar images were produced.

Having described the invention in detail and by reference to preferred embodiments thereof, it will be apparent that modifications and variations are possible without departing from the scope of the invention defined in the appended claims.

What is claimed is:

1. A process for forming images which comprises:
(a) forming a continuous layer of photosensitive microparticles, said microparticles being formed from a material which becomes tacky upon exposure to actinic radiation,
(b) image-wise exposing said layer to actinic radiation such that said microparticle become tacky in the exposed areas,
(c) assembling said layer with a receiver sheet, and
(d) transferring said microparticles to said receiver sheet in the exposed areas.

2. The process of claim 1 wherein said microparticles contain an image-forming agent.

3. The process of claim 2 wherein said image-forming agent is a color precursor, a visible dye, or a colored pigment.

4. The process of claim 3 wherein said layer of microparticles includes at least a first plurality of microparticles which become tacky upon exposure to actinic radiation of a first wavelength and a second plurality of microparticles which become tacky upon exposure to actinic radiation of a second wavelength different than said first wavelength, said first and second microparticles containing image forming agents for different colors and being uniformly distributed throughout said layer such that said process is useful in forming polychromatic images.

5. The process of claim 4 wherein said layer additionally includes a third plurality of microparticles which become tacky upon exposure to actinic radiation of a third wavelength different than said first and second wavelengths and said third plurality of microparticles containing an image-forming agent for a third color such that said process is useful in forming full color images.

6. The process of claim 5 wherein said microparticles have triboelectric properties such that said layer can be formed by depositing said microparticles on an electrically charged substrate.

7. The process of claim 6 wherein said microparticles contain a magnetic material such that said layer can be formed by distributing said microparticles on a substrate within a magnetic field.

8. The process of claim 1 wherein said microparticles are formed from a phototackifiable composition containing a degradable compound which undergoes depolymerization or decrosslinking upon exposure to actinic radiation.

9. The process of claim 8 wherein said microparticle comprises a magnetically attractable particle, said particle being coated with a mixture of said phototackifiable composition and an image-forming agent.

10. The process of claim 9 wherein said degradable compound is polyaldehyde.

11. The process of claim 1 wherein said particle is an iron particle.

12. The process of claim 1 wherein following transfer, said process includes the additional steps of uniformly exposing the microparticles not transferred to said image-receiving sheet to actinic radiation, and transferring said uniformly exposed microparticles to a second image-receiving sheet to form an image.

* * * * *